US006737596B1

(12) United States Patent
Hein

(10) Patent No.: US 6,737,596 B1
(45) Date of Patent: May 18, 2004

(54) INTEGRATED SWITCH BANK

(75) Inventor: David A. Hein, Sterling Heights, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/431,802

(22) Filed: May 8, 2003

(51) Int. Cl.[7] ..... H01H 9/02; H01H 13/70

(52) U.S. Cl. ..... 200/310; 200/314; 200/317; 200/517; 200/341

(58) Field of Search ..... 200/5 A, 512, 200/517, 296, 302.1, 302.2, 314, 341, 343–345

(56) References Cited

U.S. PATENT DOCUMENTS

| | | | | | |
|---|---|---|---|---|---|
| 4,109,118 | A | | 8/1978 | Kley | 200/5 E |
| 5,399,821 | A | * | 3/1995 | Inagaki et al. | 200/341 |
| 5,448,028 | A | | 9/1995 | Filion et al. | 200/52 R |
| 5,510,782 | A | * | 4/1996 | Norris et al. | 341/22 |
| 5,514,843 | A | | 5/1996 | Wilfong et al. | 200/5 R |
| 5,612,692 | A | | 3/1997 | Dugas et al. | 341/22 |
| 5,717,429 | A | * | 2/1998 | Coulon et al. | 345/168 |
| 5,718,326 | A | | 2/1998 | Larose et al. | 200/314 |
| 5,889,337 | A | | 3/1999 | Ito et al. | 307/10.1 |
| 5,951,349 | A | | 9/1999 | Larose et al. | 445/22 |
| 5,952,630 | A | | 9/1999 | Filion et al. | 200/5 R |
| 6,064,019 | A | * | 5/2000 | Buchan et al. | 200/302.2 |
| 6,093,900 | A | | 7/2000 | Wisskirchen et al. | 200/302.2 |
| 6,095,272 | A | | 8/2000 | Takiguchi et al. | 180/40 |
| 6,118,434 | A | | 9/2000 | Nishitani et al. | 345/173 |
| 6,331,686 | B1 | * | 12/2001 | Rogatschnig | 200/302.2 |
| 6,371,548 | B1 | | 4/2002 | Misaras | 246/146.7 |
| 6,384,355 | B1 | * | 5/2002 | Murphy et al. | 200/344 |
| 6,435,631 | B1 | | 8/2002 | Yee et al. | 312/204 |
| 6,462,291 | B1 | * | 10/2002 | Sachs | 200/302.2 |
| 6,483,048 | B1 | | 11/2002 | Bontrager et al. | 200/5 R |
| 6,573,463 | B2 | * | 6/2003 | Ono | 200/5 A |
| 2002/0112942 | A1 | | 8/2002 | Galmiche et al. | |
| 2002/0153239 | A1 | | 10/2002 | Yoshida et al. | |

OTHER PUBLICATIONS

Santoprene Thermoplastic Vulcanizate Adds Ruggedness To Handheld Computers, www.santoprene.com/site/Resource_Library/News/1975.html; Advanced Elastomer Systems, Armonk, N.Y. Oct. 5, 2001.

Santoprene Thermoplastic Elastomer Provides The 'Pure Touch' For Ergonomic Knobs, www.santoprene.com/site/Resource_Library/News/2069.html; Advanced Elastomer Systems, Northbrook, IL.

* cited by examiner

*Primary Examiner*—Michael A. Friedhofer
(74) *Attorney, Agent, or Firm*—Bill C. Panagos

(57) ABSTRACT

An integrated switch bank manufactured using multi-shot molding. The switch bank including at least one switch device, a faceplate, at least one button, and a cover. The at least one button disposed to operate a respective one of the at least one switch devices. The cover molded over at least a portion of the faceplate and at least a portion of the at least one button. The faceplate includes at least one of a front housing and a bezel. The face plate and the at least one button molded by one shot and the cover molded by another shot of the multi-shot molding. The cover generally joins and seals the at least one button to the faceplate. The cover molded over the graphics region to a thickness sufficient to permit the light to shine through the cover or reduced to permit the light to shine through the cover.

11 Claims, 4 Drawing Sheets

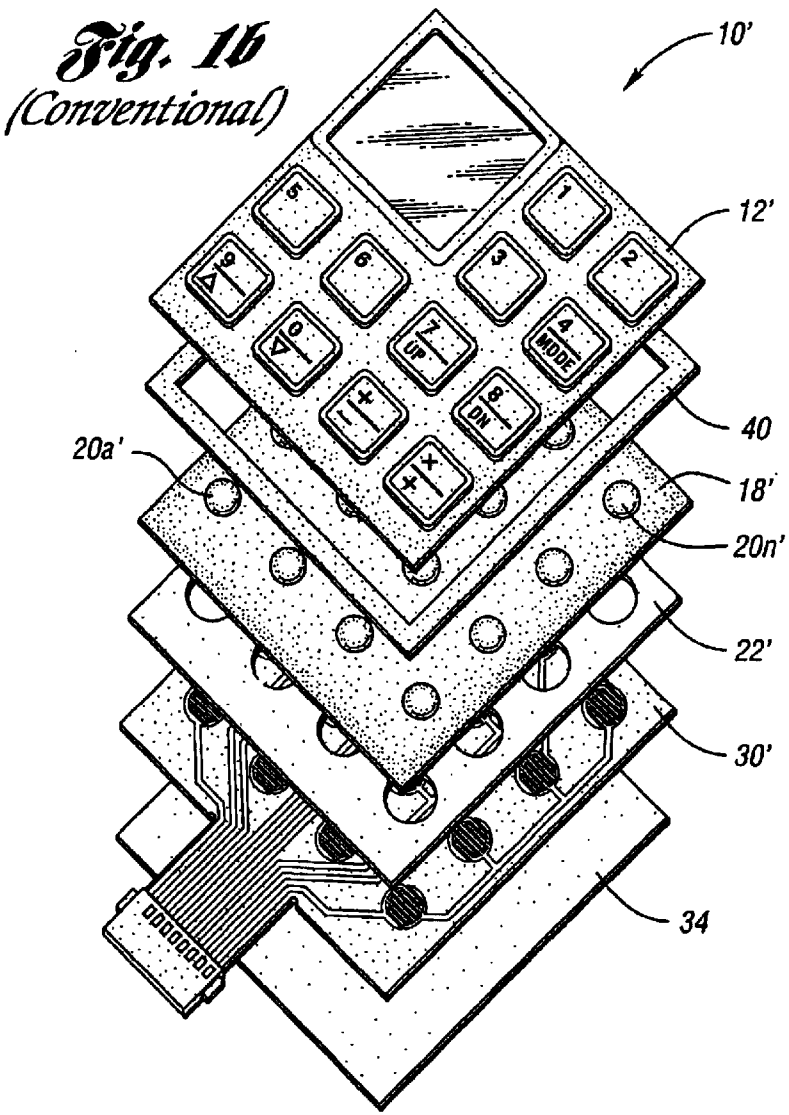
Fig. 1b (Conventional)
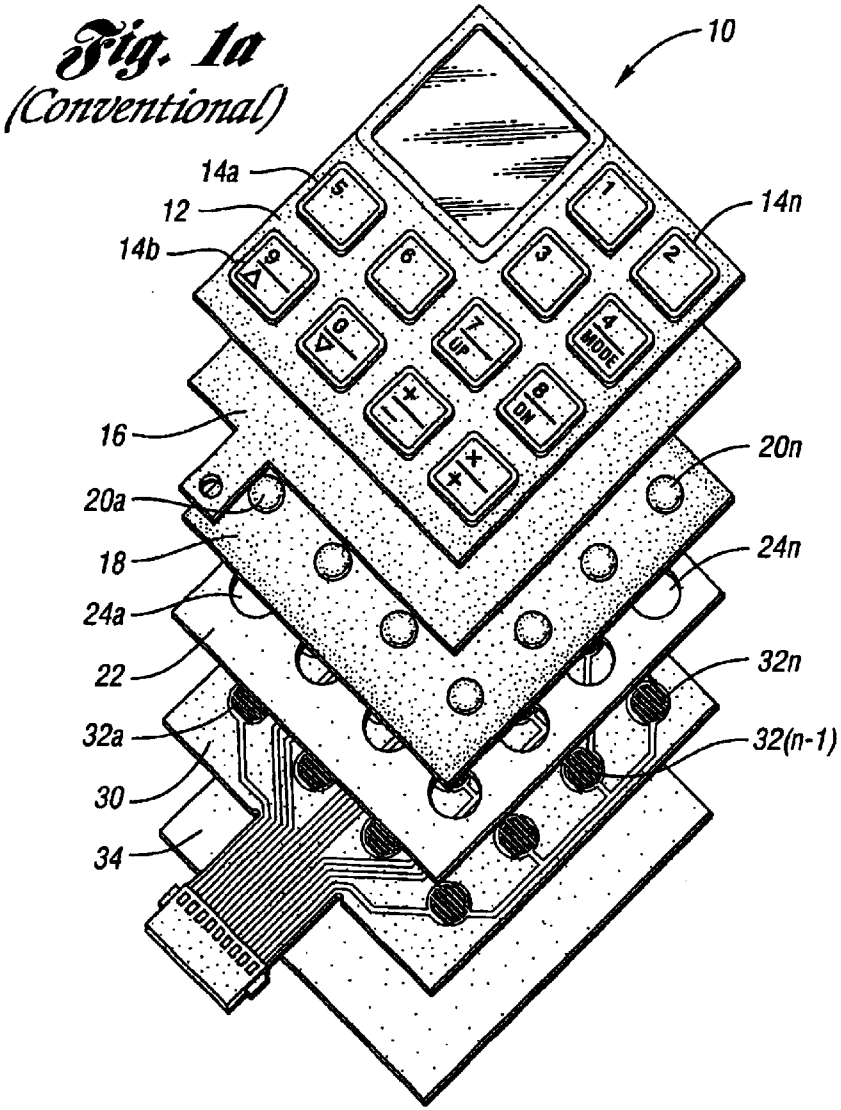
Fig. 1a (Conventional)

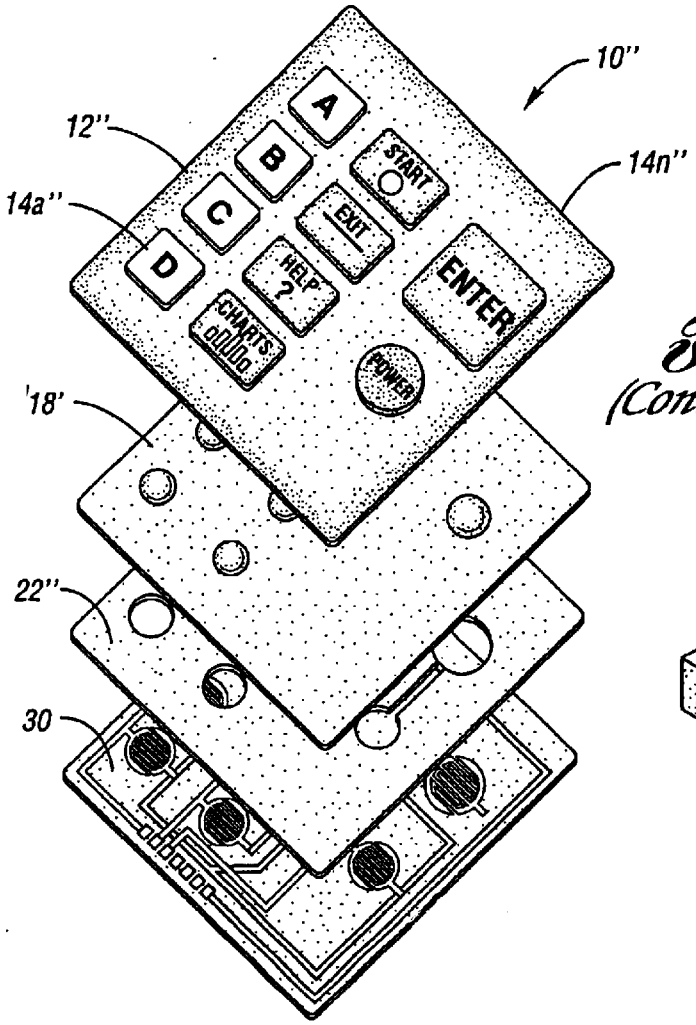
Fig. 1c
(Conventional)
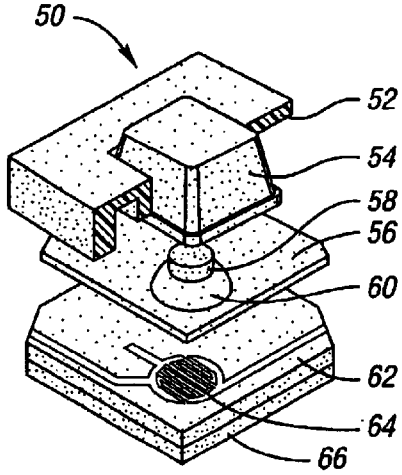
Fig. 2a
(Conventional)
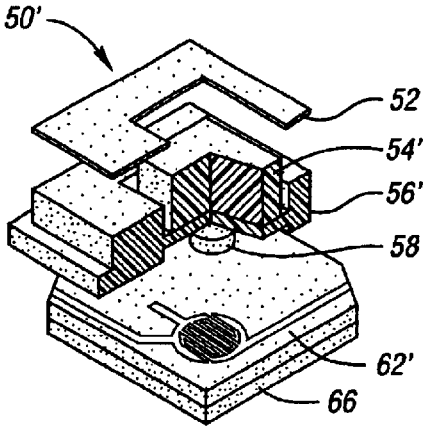
Fig. 2b
(Conventional)
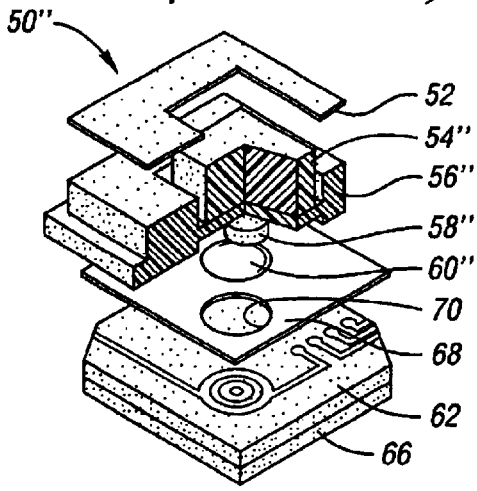
Fig. 2c
(Conventional)

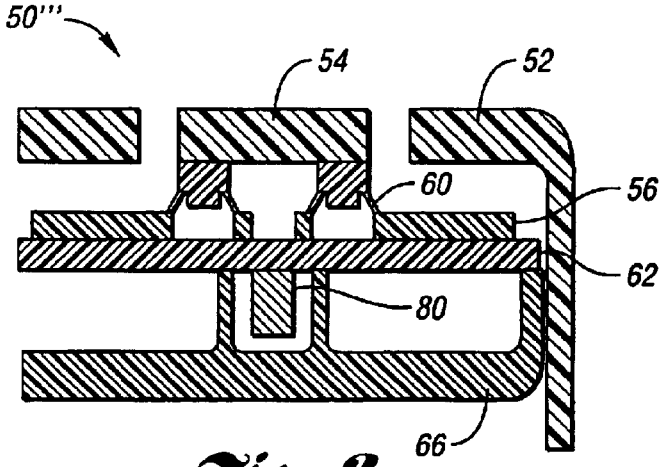
Fig. 3
(Conventional)

INTEGRATED SWITCH BANK

BACKGROUND OF THE INVENTION

1. Field of the Invention

The present invention relates to a system and a method for an integrated switch bank.

2. Background Art

Referring to FIG. 1*a*, a diagram 10 illustrating a conventional switch bank (or array) is shown. The switch bank 10 is a stacked (i.e., overlaid) structure. The switch back 10 is implemented to carry a low voltage DC signal. The switch bank 10 is a group of normally open, single pole, single throw (NO, SP, ST) momentary contact device non-tactile switches. The switch bank 10 includes a graphic overlay 12 having painted or printed on symbols 14*a*–14*n* that relate to numbers, arithmetic operators, and the like depending on the switch bank 10 application. In one example, the overlay 12 is disposed over an electrostatic discharge (ESD)/electromagnetic interference (EMI) shield 16. In another example, the overlay 12 is disposed directly over a top membrane 18. The membrane 18 has a number of contacts 20*a*–20*n* that align with the respective symbols 14*a*–14*n* when the switch bank 10 is properly assembled.

The switch bank 10 further includes a spacer 22 disposed under the membrane 18. The spacer 22 has holes 24*a*–24*n* that generally align with respective contacts 20*a*–20*n* in membrane 18. A bottom membrane (or circuit board) 30 includes circuit grids 32*a*–32*n* that generally align with respective contacts 20*a*–20*n* such that a respective circuit is closed when a user sufficiently depresses the respective symbol 14. The switch bank 10 can also include a subpanel (i.e., substrate, back cover, etc.) 34 that generally provides physical support. The stackup or overlay of the respective symbol 14, contact 20, hole 24, and grid 32 forms an individual switch in the switch bank 10.

The conventional switch bank 10 has a number of deficiencies that include when the switch bank 10 is manufactured, the layers (i.e., the overlay 12, the membrane 18, the spacer 22, the circuit board 30, and the subpanel 34) can be difficult to align such that the respective symbols, holes, and circuits align properly, the switch bank 10 is not lighted or backlit, the overlay 12 and the symbols 14 are not registered (i.e., the surface of the overlay 12 is substantially smooth such that a user can not readily discern switch location and type by feel), and the switch bank 10 does not provide tactile feedback feel to the user.

However, the user generally prefers switches that have a tactile feel such that actuation of the switch provides positive feedback such as a snap to indicate switch operation. A tactile switch can be defined (e.g., by American Society for Testing and Materials standards ASTM F 1570-01e1 and F 1997-99) as a switch having a tactile ratio greater than zero. Furthermore, tactile indication of the respective switch symbol and/or switch lighting is desirable in many applications such that the user can readily identify the appropriate switch in a low light environment.

Referring to FIG. 1*b*, a diagram illustrating a conventional switch bank 10' is shown. The conventional switch bank 10' is similar to the switch bank 10. To provide a tactile feel, the switch bank 10' includes a spacer 40 disposed between the overlay 12 and a membrane 18'. The membrane 18' implements domes 20*a*'–20*n*' instead of the membrane contacts 20*a*–20*n* of switch bank 10. Depressing the membrane 12 at a symbol 14 of the switch bank 10' collapses a respective dome 20' to provide the tactile response to the user. However, the conventional switch bank 10' has a number of deficiencies. During manufacturing the layers can be difficult to align such that the respective symbols, domes, holes, and circuits align properly. The switch bank 10' is not lighted, and the overlay 12 and the symbols 14 do not provide tactile registration.

Referring to FIG. 1*c*, a diagram illustrating a conventional switch bank 10" is shown. The switch bank 10" is implemented similarly to the switch banks 10 and 10'. To provide a tactile feel switch bank, the switch bank 10" has a non-tactile overlay 12" made of an elastomer rubber having raised symbols 14" (i.e., buttons) to provide the tactile registration. The membrane 18' can provide a limited tactile feel. The switch bank 10" also substitutes an adhesive spacer 22" for the spacer 22. However, during manufacturing the layers can be difficult to align such that the respective symbols, domes, holes, and circuits align properly. The switch bank 10" is not lighted, and the tactile feel provided by the membrane 18' is reduced by the relatively thick and soft buttons 14".

Referring to FIG. 2*a*, a diagram illustrating an exploded, sectional view of a conventional switch (or cell) 50 is shown. A number of the switches 50 may be integrated (i.e., combined or implemented as an array) to provide a switch bank similar to the switch banks 10, 10', and 10". The switch 50 includes an overlay/bezel 52 with a hole that has a shape similar to a key top (or cap) 54. The key top 54 is hard plastic and protrudes through the bezel 52 and the bezel 52 generally positions the key top 54. The key top 54 is disposed onto a rubber keypad 56 that has a carbon or metallic pill (or puck) 58 on top of a dome 60. The dome 60 is disposed above a bottom membrane (or circuit board) 62 that has a circuit grid 64. The switch 50 may be disposed on a subpanel (i.e., substrate, back cover, etc.) 66 that provides physical support. To actuate the switch 50, the user depresses the key top 54, the key top 54 collapses the dome 60, and the pill 58 contacts the grid 64 to complete a circuit. The dome 60 provides tactile feel to the switch 50, however, the tactile feel is limited by the interface between the cap 54 and the pill 58.

The conventional switch bank 50 is not sealed at the interface between the bezel 52 and the key top 54 and debris can enter the interface and interfere with proper switch operation. During manufacturing the layers (i.e., the bezel 52, the key top 54, the keypad 56, and the membrane 62) can be difficult to align (i.e., gaps can be difficult to control) such that the respective key tops, domes, and circuits align properly, and the switch 50 is not lighted. Each key top 54 is typically individually molded, painted and assembled into the switch 50 assembly.

The alignment of the bezel 52 and the key top 54 is critical to the proper operation and feel of the switch 50. When the gaps between the bezel 52 and the key top 54 are not properly sized or aligned the key tops 54 can be too tight and bind, too loose and wobble and result in reduction or loss of tactile feel, and in any case fail to cause the pill 58 to properly contact the grid 64.

Referring to FIG. 2*b*, a diagram illustrating a conventional switch (or cell) 50' is shown. The switch 50' is implemented similarly to the switch 50. The switch 50' includes a tactile rubber keypad 56' having a formed key 54' that protrudes through the bezel 52. The key 54'/keypad 56' can be formed from a dual durometer molding where the key 54' is implemented using a rubber that is harder than the keypad 56'. The pill 58 is fixed to the underside of the key 54'. The conventional switch bank 50' has similar deficiencies to the switch 50.

Referring to FIG. 2*c*, a diagram illustrating a conventional switch (or cell) 50" is shown. The switch 50" is implemented similarly to the switches 50 and 50'. The switch 50" includes a non-tactile rubber keypad 56" having a formed key 54" that protrudes through the bezel 52. The pill 58 is fixed to the underside of the key 54". A metal dome 60" is disposed to align with the pill 58 and to provide tactile feel. A spacer 68 having a hole 70 is disposed such that when the switch 50" is actuated, the pill 58 travels through the hole 70 to contact the grid 64. The conventional switch bank 50" has similar deficiencies to the switch 50.

Referring to FIG. 3, a diagram illustrating a conventional switch (or cell) 50'" is shown. The switch 50'" is implemented similarly to the switch 50. The switch 50'" includes a light emitting diode (LED) or other appropriate light source 80 disposed such that the switch 50'" is lighted (i.e., back-lit). The conventional switch 50'" has similar deficiencies to the switch 50 except that the switch 50'" provides lighting.

In another example, U.S. Pat. No. 6,483,048 to Bontrager et al. discloses yet another conventional switch approach. Bontrager discloses a switch incorporated in a foam layer of an automotive trim panel. The switch disclosed by Bontrager does not provide registration, does not provide for tactile feel, and is not backlit. Furthermore, since the switch is implemented in a foam, the location of the switch can not be controlled during manufacture, the mechanical properties of the foam (and thus the feel of the switch) can not be controlled, the foam can interfere with mechanical and electrical operation of the switch, and as the foam deteriorates over time and use, the feel of the switch will change.

Thus, there exists a need for an improved system and an improved method for an integrated switch bank. The present invention may provide improved button to bezel alignment, graphic registration, and a sealed faceplate. The present invention may also provide reduced system cost and improved system quality when compared to conventional approaches.

SUMMARY OF THE INVENTION

The present invention generally provides new, improved and innovative techniques for an integrated switch bank. The present invention may generate key caps (or buttons), graphics and bezel (or faceplate) as a two shot molding process. The present invention may provide improved button to bezel alignment, graphic registration, and a sealed faceplate. The present invention may also provide reduced system cost and improved system quality when compared to conventional approaches.

According to the present invention, an integrated switch bank manufactured using multi-shot molding is provided. The switch bank comprising at least one switch device, a faceplate, at least one button disposed to operate a respective one of the at least one switch devices, and a cover molded over at least a portion of the faceplate and at least a portion of the at least one button, wherein the faceplate comprises at least one of a front housing and a bezel, the at least one button are molded by one shot and the cover is molded by another shot of the multi-shot molding, and the cover joins and seals the at least one button to the faceplate.

Also according to the present invention, a method of manufacturing an integrated switch bank using multi-shot molding is provided. The method comprising molding a faceplate and at least one button by one shot of the multi-shot molding, and molding a cover over at least a portion of the faceplate and at least a portion of the at least one button by another shot of the multi-shot molding, wherein the faceplate comprises at least one of a front housing and a bezel, the at least one button is disposed for operating a respective switch device, and the cover joins and seals the at least one button to the faceplate.

Further, according to the present invention, an illuminated graphics apparatus manufactured using multi-shot molding is provided. The apparatus comprising an optically clear, transparent, semi-transparent, or translucent faceplate comprising at least one of a front housing, a graphics display, and a bezel, the faceplate molded by a one shot of the multi-molding process, and having a graphics region, at least one light source disposed to shine light through the graphics region; and a nominally opaque cover molded over at least a portion of the faceplate by another shot of the multi-molding process.

The above features, and other features and advantages of the present invention are readily apparent from the following detailed descriptions thereof when taken in connection with the accompanying drawings.

BRIEF DESCRIPTION OF THE DRAWINGS

FIGS. 1(*a–c*) are exploded isometric views of conventional switch banks;

FIGS. 2(*a–c*) are exploded, sectional isometric views of other conventional switches;

FIG. 3 is a sectional view of another conventional switch;

DETAILED DESCRIPTION OF THE PREFERRED EMBODIMENT(S)

With reference to the Figures, the preferred embodiments of the present invention will now be described in detail. Generally, the present invention provides an improved system and an improved method for an integrated switch bank and an improved illuminated graphics display. The present invention may generate key caps (or buttons), graphics and bezel (or faceplate) using a two shot molding process. The present invention may provide improved button to bezel alignment, graphic registration, a sealed faceplate, and reduced system cost and improved system quality when compared to conventional approaches.

Referring to FIGS. 4(*a–e*), diagrams illustrating example embodiments of a switch (or cell) or apparatus 100 in accordance with the present invention are shown. A number of the switches 100 may be integrated (i.e., combined, configured, implemented as an array, etc.) to provide an integrated switch bank (not shown). The switch 100 is generally implemented as an electrical switch. In another example, the switch 100 may be implemented as a mechanical switch (i.e., actuator, release, etc.). However, the switch or apparatus 100 may be implemented as any appropriate control apparatus or mechanism, and/or illuminated graphics display to meet the design criteria of a particular application.

Figure 4A:
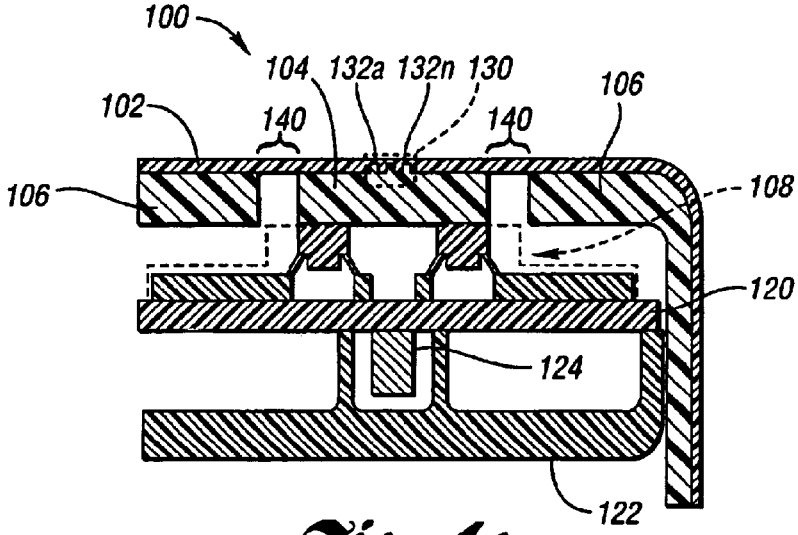
FIGS. 4(*a–e*) are diagrams of switches according to the present invention.

Referring in particular to FIG. 4*a*, a sectional view (taken at line 200 of FIG. 4*b*) illustrating an example of the switch 100 is shown. The switch 100 generally comprises a cover (i.e., fascia, film, etc.) 102, a button (or knob) 104, a faceplate (e.g., front housing, bezel, etc.) 106, a switching device 108, a board (generally a printed circuit board, PCB) 120, a substrate (e.g., backplate, subpanel, etc.) 122, and a lighting source 124. The switch device 108, the substrate 122, and/or the lighting source 124 may be deleted when not required to meet the design criteria of a particular application.

The cover 102 is generally disposed over at least a portion of the at least one button 104 and at least a portion of the faceplate (or front housing) 106. The cover 102 generally joins and seals the button 104 to the faceplate 106. The switch 100 is generally manufactured using a multi-shot (i.e., an at least two shot (or two step)) molding process (described in more detail in connection with FIG. 5). The button 104 (including graphics) and the front housing or faceplate 106 are generally molded as one or a first of the at least two shots of the multi-shot molding process and the cover 102 is generally molded as another or a second shot of the molding process. In one example, the two (or more) shot molding process that may be implemented to generate the switch or apparatus 100 may provide a gap region 140 between the button 104 and the bezel 106. Since the button 104 and the bezel 106 are molded as a single step, the gap 140 (i.e., the alignment of the button 104 and the bezel 106) is generally well controlled in contrast to conventional switch approaches where the button 104 and the bezel 106 are molded separately and the gap between the button and the bezel is difficult to align properly and control. In one example of a mold implemented to manufacture the switch 100, at least one flash gate (not shown) may be implemented between the button 104 and the faceplate 106.

The cover 102 generally comprises an opaque thermoplastic elastomer (TPE) material. The button 104 and the faceplate 106 generally comprise an optically clear, transparent, semi-transparent, or translucent material. The material implemented to produce the button 104 and the front housing 106 may be implemented as polycarbonate (PC), acrylonitrile butadiene styrene (ABS), polypropylene, and the like. However, the cover 102, and the 104 and the faceplate 106 may be molded using any appropriate materials and having any appropriate degree of transparency to meet the design criteria of a particular application. The cover 102 may be processed (e.g., etched, removed, reduced, stippled, painted, etc.) further during operations sequent to the two shot molding operation. The cover 102 generally joins and seals the button 104 and the faceplate 106.

The button 104 is generally disposed to actuate the device 108. In the case where the device 108 is implemented as an electrical switch, the board 120 is generally implemented as a PCB and the device 108 is generally disposed such the device 108 contacts a grid portion (not shown) of the PCB 120 and a respective electrical circuit is completed. In the case where the switch 100 is implemented as a mechanical switch, the device 108 may actuate any appropriate mechanism such as a push rod, trigger, lever, transfer bar, and the like (not shown).

The button 104 generally comprises a graphics area (or region) 130. In one example, the graphics area 130 may include markers 132*a*–132*n* that are implemented as extensions (i.e., protrusions, raises, ridges, bumps, etc.) that extend above a top surface of the button 104. In another example, the markers 132*a*–132*n* may be implemented as depressions (i.e., dips, ditches, fossa, grooves, recesses, etc.) that extend below the top surface of the button 104. The markers 132 are generally implemented as symbols (e.g., ISO symbols), text, graphics, alphanumeric characters, arithmetic operators, and the like that provide tactile and/or visual registration such that an operator (or user) can discern the operation that is generally controlled or the value that is generally represented by the switch 100.

In yet another example, when the cover 102 is substantially flush with raised markers 132 (as shown, for example, in FIG. 4*c*), the markers 132 may provide tactile registration to the switch 100 due to the general difference in feel between the material implemented for the cover 102 and the material implemented for the button 104. When the cover 102 is not molded on the button 104 in the graphics 130 (as shown, for example, in FIG. 4*d*), the markers 132 may provide tactile registration to the switch 100.

In another example, even when the cover 102 is molded over the markers 132 or when the cover 102 is substantially flush with raised markers 132, the user may be provided visual registration (e.g., the respective symbols may be painted on the cover 102, the light source 124 may shine light through the markers 132 of the graphics 130 of the button 104, or the light source 124 may shine light through the button 104 and the nominally opaque cover 102 to illuminate the graphics 130).

In the case where the cover 102 is molded over the markers 132 and the user is provided visual registration via the light source 124 shining light through the button 104 and the nominally opaque cover 102, the thickness of the nominally opaque cover 102 is formed, processed, or selected (i.e., molded, produced, reduced, etched, laser etched, ground, etc.) such that desired mechanical properties of the cover (e.g., wear resistance, sealing, surface feel, etc.) are maintained while semi-transparent or translucent light transmissibility is provided in contrast to conventional approaches where switches having a cover made of nominally opaque material are not backlit due to the cover being considered opaque. The cover 102 may be implemented having a thickness (i.e., with a thickness sufficient) that permits or allows passage of light from the light source 124 such that the graphics 130 are illuminated. In one example, the thickness of the cover 102 may be determined when the cover 102 is molded. In another example, the thickness of the cover 102 may be determined using a post-molding process (e.g., a process to reduce the thickness) such that the graphics 130 are illuminated.

In one example, the device 108 may be implemented as a non-tactile electrical switch. In another example, the device 108 may be implemented as a tactile electrical switch. In yet another example, the device 108 may be implemented as a metallic dome or a membrane switch. In yet another example, the device 108 may be implemented as a capacitive or electric field switch. However, the device 108 may be implemented as any appropriate switch device to meet the design criteria of a particular application. In another example (described in detail in connection with FIG. 4*d*), the device 108 may be deleted.

The backplate 122, when implemented, generally provides support, sealing, and the like to the switch 100. The light source 124 is generally implemented as a light emitting diode (LED), light pipe, fiber optic, luminescent surface device, and the like.

In another example (not shown), the apparatus 100 may be molded without the gap 140. The button 104 and the graphics 130 (including the markers 132) may be integrated in the faceplate 106. The switch device 108 may be deleted. The apparatus 100 may be implemented as a back-lit graphics faceplate (e.g., front housing, display panel, etc.).

Figure 4B:
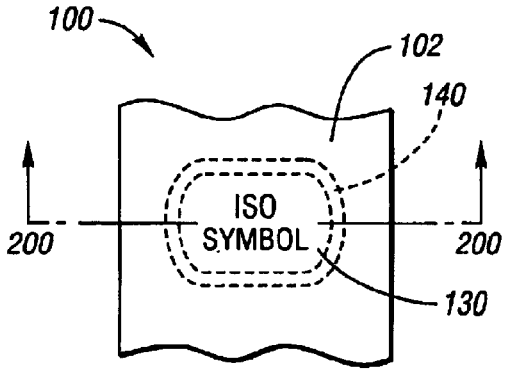

Referring to FIG. 4*b*, a top view of the switch 100 is shown. While the gap 140 is illustrated as substantially equal, the gap 140 may be implemented as any appropriate width pattern (e.g., more wide in one pair of opposing sides than the other pair of opposing sides in the case of a rocker switch) to meet the design criteria of a particular application.

Figure 4C:
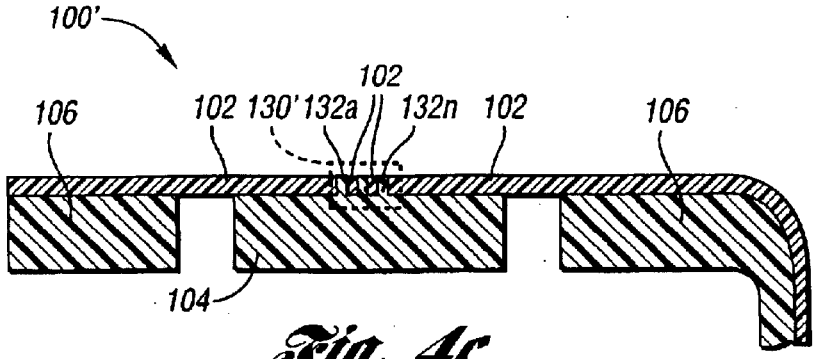
Figure 4B:
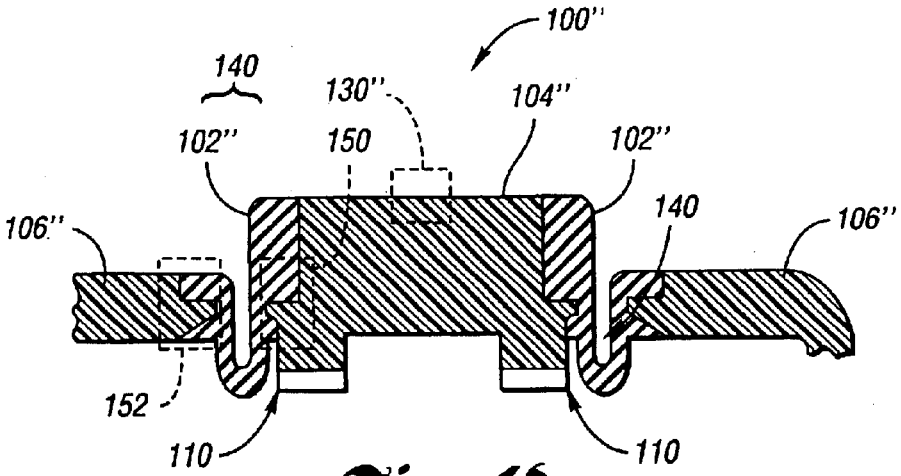

Referring to FIG. 4*c*, a sectional view of a switch 100' is shown. The switch 100' may be implemented similarly to the switch 100. The switch 100' generally comprises a cover 102' and a graphics region 130'. In one example, the cover 102' may be removed (e.g., laser etched, reduced, ground, etc.) such that the markers 132 are substantially flush with the surface of the cover 102'. In another example, the cover 102' may be molded substantially flush with the surface of the markers 132.

Referring to FIG. 4*d*, a sectional view of a switch 100" is shown. The switch 100" may be implemented similarly to the switch 100. The switch 100" generally comprises a cover 102", a button 104", a bezel 106", and a graphics region 130". In one example (e.g., an electrical switch implementation), the switch 100" may include at least one conductive region 110 on a lower surface of the button 104". The conductive region 110 generally comprises at least one conductive material (e.g., molded region, metallic plating or painting, a disk, pill or puck configured from a conductive material such as carbon or a metal, and the like) that is affixed, joined, applied, etc. and disposed to contact a grid region (not shown) on the PCB 120, trigger a field sensing device (not shown), or the like. The device 108 may be deleted. When an electrical switch 100" is actuated, the region 110 may complete a circuit.

The cover 102" may be molded such that a portion of the button 104" and a portion of the faceplate 106" are covered. The portion of the button 104" and a portion of the faceplate 106" that are covered may correspond to the gap region 140 and an overlap region 150 in the button 104" and an overlap region 152 in the faceplate 106". The cover 102" may be molded (e.g., in a convoluted or folded shape) such that the gap region 140 performs a snap action hinge operation when the switch 100" is actuated. However, the cover 102" may be molded having any appropriate shape to meet the design criteria of a particular application.

The graphics region 130" is generally implemented similar to the region 130. In one example, the graphics region 130" may be implemented as painted or printed on graphics. In other examples (not shown), the graphics region 130 may include the raised and/or depressed markers 132.

Figure 4E:
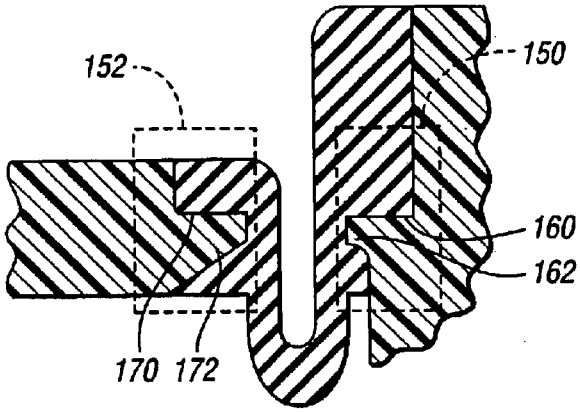

Referring to FIG. 4*e*, detailed illustrations of the regions 150 and 152 are shown. In one example, the region 150 may include a ridge (e.g., terrace, plateau, etc.) area 160 that projects perpendicularly, radially outward from a radial surface of the button 104" and an adjacent lip (or outcropping) 162 that projects radially outward from the radial surface of the button 104". The region 152 may include a ridge area 170 that projects perpendicularly, radially inward towards the radial surface of the button 104" and an adjacent lip 172 that projects radially inward toward the radial surface of the button 104". The regions 150 and 152 may provide a robust seal at the interface of the button 104" and the bezel 106". However, the overlap regions 150 and 152 may be implemented having any appropriate shape to meet the design criteria of a particular application.

Figure 5:
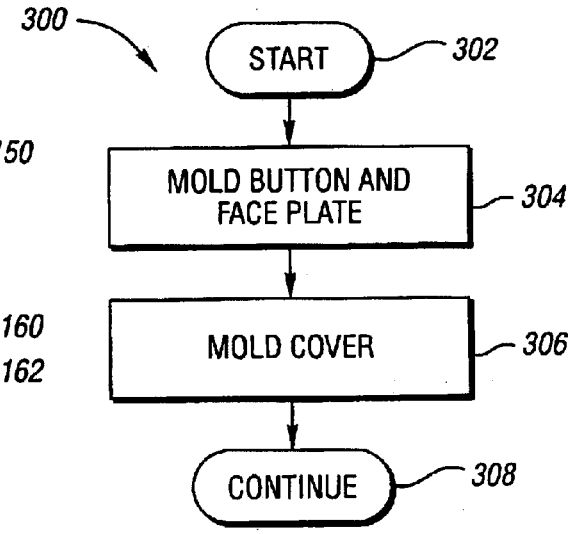
FIG. 5 is a flow diagram of an operation according to the present invention.

Referring to FIG. 5, a flow diagram illustrating a operation (i.e., method, process, routine, procedure, steps, etc.) 300 in accordance with the present invention is shown. The process 300 is generally implemented as a multi-shot (or step) molding process. The process 300 generally comprises at least two shots (or steps). The process 300 may be implemented in connection with (i.e., implemented to generate, produce, manufacture, etc.) the apparatus or switch 100 (or any embodiment thereof such as the switches 100', 100", etc.) of the present invention. However, the method 300 may be implemented in connection with any appropriate switch, apparatus, faceplate, front housing, display panel, illuminated graphics display, etc. to meet the design criteria of a particular application.

After the process 300 starts (step or block 302), the process 300 may mold at least one switch button (or cap) and a switch faceplate (or bezel) such as the cap 104 and the bezel 106, respectively (step or block 304). The button and the bezel are generally molded as a single, one or a first step of the at least two step molding process. The process 300 may mold a cover (or fascia) such as the cover 102 (step or block 306). The cover is generally molded as a single, another or second step of the multi-step molding process 300. The cover is generally molded over at least a portion of the button and over at least a portion of the bezel. The cover generally joins and seals the button and the faceplate. The cover generally covers at least a portion of the faceplate. In one example, the cover may be molded over the entire facing surface of the faceplate (or front housing, display panel, etc.). The process 300 may continue (step or block 308).

In one example, the method 300 may include additional steps (not shown). For example, the process 300 may include at least one step to perform the removal (or reduction) of material of the cover such that the nominally opaque cover is of a thickness that allows (or permits) passage of light (i.e., light transmissibility) from a light source through the nominally opaque cover material.

As is readily apparent from the foregoing description, then, the present invention generally provides an improved apparatus (e.g., the switch 100) and/or an improved method (e.g., the method 300) for an integrated switch bank. The present invention may provide improved button to bezel alignment, graphic registration, and a sealed faceplate. The present invention may provide reduced system cost and improved system quality when compared to conventional approaches.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An integrated switch bank manufactured using multi-shot molding, the switch bank comprising:

a faceplate;

at least one button disposed to operate a respective switch device;

at least one light source disposed to shine through a graphics region of a respective button; and a cover molded over at a portion of the faceplate and at least a portion of the at least one button, wherein the faceplate comprises at least one of a front housing and a bezel, the at least one button is molded by one shot and the cover is molded by another shot of the multi-shot molding, the cover joins and seals the at least one button to the faceplate, the faceplate and the at least one button comprise an optically clear, transparent, semi-transparent, or translucent material, the cover comprises a nominally opaque thermoplastic elastomer (TPE) material, the cover is semi-transparent over the graphics region, and the cover is of a thickness sufficient to permit the light to shine translucently through the cover.

2. The switch bank of claim 1 wherein the switch device comprises a conductive material affixed to the least one button and disposed to trigger a field sensing device.

3. The switch bank of claim 1 wherein the cover is molded over the graphics region and thickness of the cover is reduced to permit the light to shine through the cover.

4. The switch bank of claim 1 wherein the at least one switch device is a tactile feel switch device.

5. The switch bank of claim 1 wherein the at least one switch device is at least one of an electrical switch device and a mechanical switch device.

6. The switch bank of claim 1 wherein the switch device comprises a conductive material affixed to the at least one button and disposed to contact a grid to complete an electrical circuit.

7. A method of manufacturing an integrated switch bank using multi-shot molding, the method comprising:

molding a faceplate and at least one button by one shot of the multi-shot molding; and molding a cover over at least a portion of the faceplate and at least a portion of the at least one button by another shot of the multi-shot molding, wherein the faceplate comprises at least one of a front housing and a bezel, the at least one button is disposed for operating a respective switch device, the cover joins and seals the at least one button to the faceplate, at least one light source is disposed to shine light through a graphics region a respective button, the faceplate and the at least one button comprise an optically clear, transparent, semi-transparent, or translucent material, the cover comprises a nominally opaque thermoplastic elastomer (TPE) material, the cover is semi-transparent over the graphics region, and the cover is of a thickness sufficient to permit the light to shine translucently through the cover.

8. The method of claim 7 wherein the switch device comprises a conductive material affixed to the at least one button, and wherein the conductive material is disposed to trigger a field sensing device.

9. The method of claim 7 wherein the cover is molded over the graphics region and thickness of the cover is reduced to permit the light to shine through the cover.

10. An illuminated graphics apparatus manufactured using multi-shot molding, the apparatus comprising:

an optically clear, transparent, semi-transparent, or translucent faceplate comprising at least one of a front housing, a graphics display, and a bezel, the faceplate molded by a one shot of the multi-molding process, and having a graphics region;

at least one light source disposed to shine light through the graphics region; and a nominally opaque cover molded over at least a portion of the faceplate by another shot of the multi-molding process wherein the cover comprises a nominally opaque thermoplastic elastomer (TPE) material, the cover is semi-transparent over the graphics region, and the cover is of a thickness sufficient to permit the light to shine translucently through the cover.

11. The apparatus of claim 10 wherein the cover is molded over the graphics region and thickness of the cover is reduced to permit the light to shine through the cover.

* * * * *